United States Patent [19]

Wang

[11] Patent Number: 5,018,231

[45] Date of Patent: May 28, 1991

[54] NECK GUARD PILLOW

[76] Inventor: Jason Wang, 2245 Watt St., Reno, Nev. 89509

[21] Appl. No.: 572,772

[22] Filed: Aug. 27, 1990

[51] Int. Cl.[5] ..... A47G 9/00

[52] U.S. Cl. ..... 5/436; 5/434

[58] Field of Search ..... 5/434, 436, 437, 491

[56] References Cited

U.S. PATENT DOCUMENTS

| | | | |
|---|---|---|---|
| 1,580,210 | 4/1976 | McCulloch | 5/436 X |
| 2,940,088 | 6/1960 | Roos | 5/436 |
| 4,218,792 | 8/1980 | Kogan | 5/436 |
| 4,768,246 | 9/1988 | Summer | 5/436 X |
| 4,788,728 | 12/1988 | Lake | 5/436 X |

FOREIGN PATENT DOCUMENTS

| | | | |
|---|---|---|---|
| 8101524 | 11/1981 | Fed. Rep. of Germany | 5/436 |

*Primary Examiner*—Michael F. Trettel

*Attorney, Agent, or Firm*—Russell W. Illich

[57] ABSTRACT

A contoured pillow is provided which is designed to accommodate a person sleeping in the supine position or in a side position. The pillow includes a curved ridge along one edge of the pillow to support the neck. The ridge ends in an elliptical depression within the center of the pillow to support the back of a person's head. The elliptical depression allows a person's head a freedom of movement of 45° from either side of its normal vertical position and allows bending of the neck to a certain degree. Along the sides of the depression the pillow is of a greater dimension to support the head when resting on the side of the head. The pillow further includes longitudinal grooves within the side regions of the pillow to prevent a person's ear from being overly compressed against the pillow when resting on one's side. The pillow is of a conventional size and shape and can be used with standard pillow cases, standard sized beds, etc.

4 Claims, 2 Drawing Sheets

Fig. 5
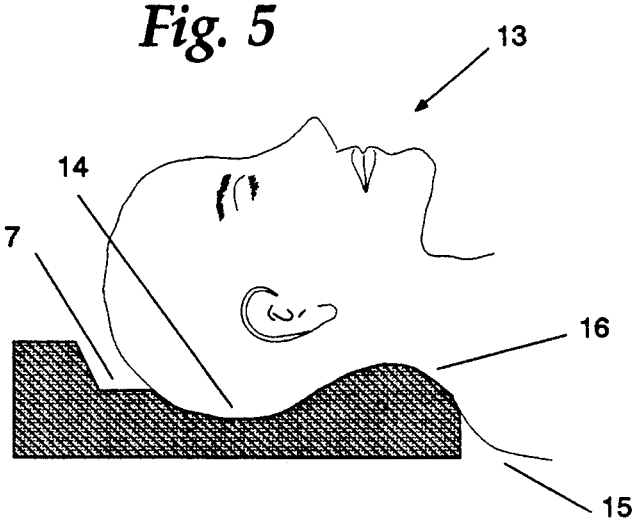
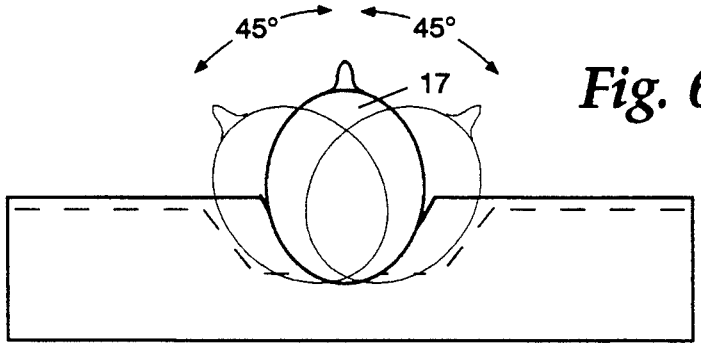
Fig. 6
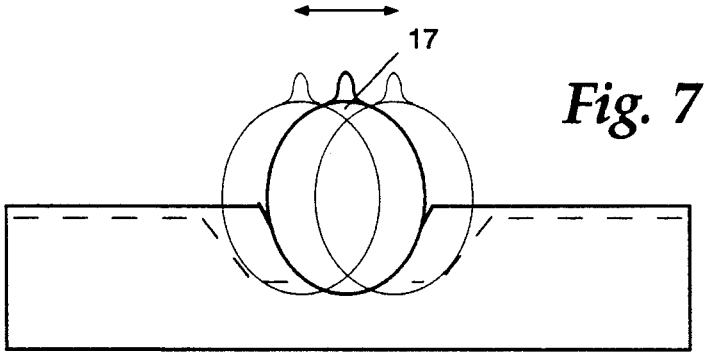
Fig. 7
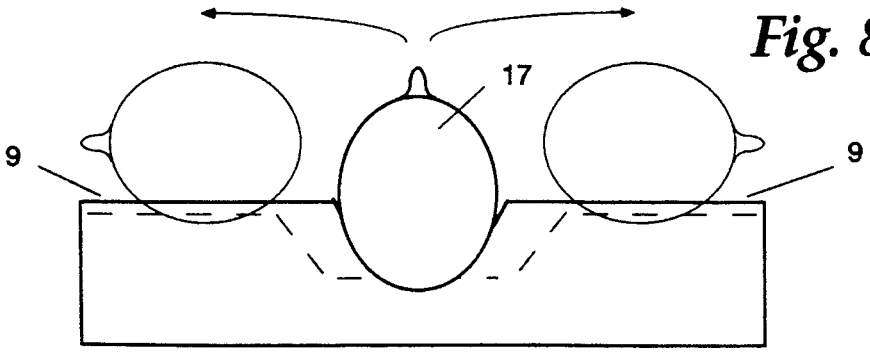
Fig. 8

NECK GUARD PILLOW

BACKGROUND OF THE INVENTION

The present invention relates to the field of pillow and specifically to pillows that prevent stress in the head, neck, and shoulders of a person while sleeping. Conventional pillows can cause headaches or muscle tightness in the neck and shoulders by having the wrong height or being positioned wrong on the head and neck. Several prior art pillows have attempted to address this problem with conventional pillows by providing means to properly position the head. Unfortunately all of the prior art pillows have inherent disadvantages associated with them.

U.S. Pat. No. 4,850,068 to Walpin includes a front ridge for supporting a person's neck. This feature prevents stress when a person is sleeping on his/her back. However, this pillow fails to provide a means for a person to comfortably rest on his/her side. The larger dimension between a person's shoulder and neck while sleeping on his/her side can produce stress in a person's neck while using Walpin's pillow.

U.S. Pat. No. 3,243,828 to McCarty provides a pillow that can be used for sleeping on one's side or back. However, McCarty fails to provide any support for a person's neck. The long dimension of the pillow can also cause a sleeping person to position his/her head in the wrong position on the pillow.

U.S. Pat. No. 3,574,397 to Norries discloses a pillow that has a hollowed area for cradling one's head in either a side or back position. Since a person tends to roll his/her head around while sleeping, this pillow could cause a person to wake up when his/her head falls out of the pillow.

U.S. Pat. No. 4,494,261 to Morrow discloses a pillow that is primarily to be used while a person is lying on his/her back as shown in FIGS. 3 and 4. All of the disadvantages of Walpin's pillow also apply to this pillow. Additionally, FIG. 4 of Morrow shows that the pillow does not provide a comfortable means for allowing the head to roll from side to side. The head must remain in vertical and centered position.

U.S. Pat. No. 3,981,032 to Brooks is an odd shaped pillow with many different contours. Firt, the pillow does not give a person good neck support while sleeping. Second, the pillow is so complicated that it is highly unlikely a sleeping person will position the pillow properly beneath his/her head. Finally, the pillow is costly to manufacture and would be impractical in use.

One additional disadvantage of the pillows shown by Brooks, McCarty and Norries is that their shapes are unconventional and would not fit standard pillow cases or standard beds.

SUMMARY OF THE INVENTION

It is an object of this invention to provide a pillow that allows a person to sleep comfortably on one's back or side and relieve or prevent stress from building in one's head, neck and/or shoulders.

Another object of the invention is to provide a pillow that allows a person to change positions while sleeping and automatically position the head, neck and shoulders in the correct position.

It is a further object of the invention to provide a pillow that is relatively conventional in shape, simple in design and use, and cost-effective to manufacture.

Other objects of the invention will be apparent hereinafter from the specification and from the recital of the appended claims, particularly when read in conjunction with the accompany drawings.

The present invention comprises a contoured pillow which is designed to accommodate a person sleeping in the supine (or back) position or in a side position. The pillow includes a curved neck support along one edge of the pillow that ends in an elliptical depression within the center of the pillow to support the back of a person's head. The elliptical depression allows a person's head a freedom of rotation of 45° from either side of its normal vertical position. The width of the depression also allows the head to move from side to side within the depression and allows room for the natural bending of a person's neck within the depression. Along the sides of the depression the pillow is of a greater dimension to support the head when resting on the side of the head. The pillow further includes longitudinal grooves within the side regions of the pillow to prevent a person's ear from being overly compressed against the pillow when resting on one's side. The pillow is of a conventional size and shape and can be used with standard pillow cases, etc.

BRIEF DESCRIPTION OF THE DRAWINGS

FIG. 5 shows a cross-sectional view along line A—A of FIG. 2 with a person's head positioned within the pillow.

FIGS. 6–8 show a view of the pillow similar to FIG. 3 with a person's head in a variety of positions on the pillow.

DETAILED DESCRIPTION OF THE INVENTION

Figure 1:
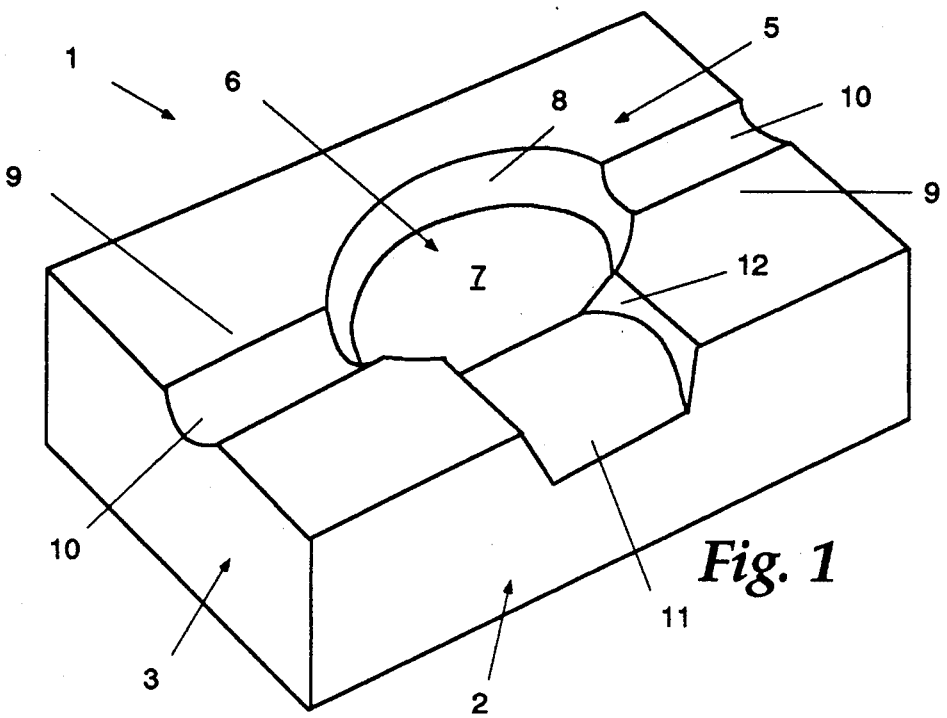
FIG. 1 shows a perspective view of the contoured pillow of the present invention.

FIGS. 1–4 show the preferred embodiment of the contoured pillow 1 of the present invention. The pillow is of a conventional shape with various depressions, ridges and grooves within its six sides as will be explained below. The pillow includes a front panel 2, two side panels 3, a back panel 4, and a top panel 5, and a bottom panel (not shown). The entire pillow is made of a single piece of material and can be formed as a single contoured piece of foam material traditionally used in pillow construction. Conversely, the pillow can be made from a solid six sided piece of foam material which is subsequently cut and formed to form the contoured pillow of FIGS. 1–4.

Figure 2:
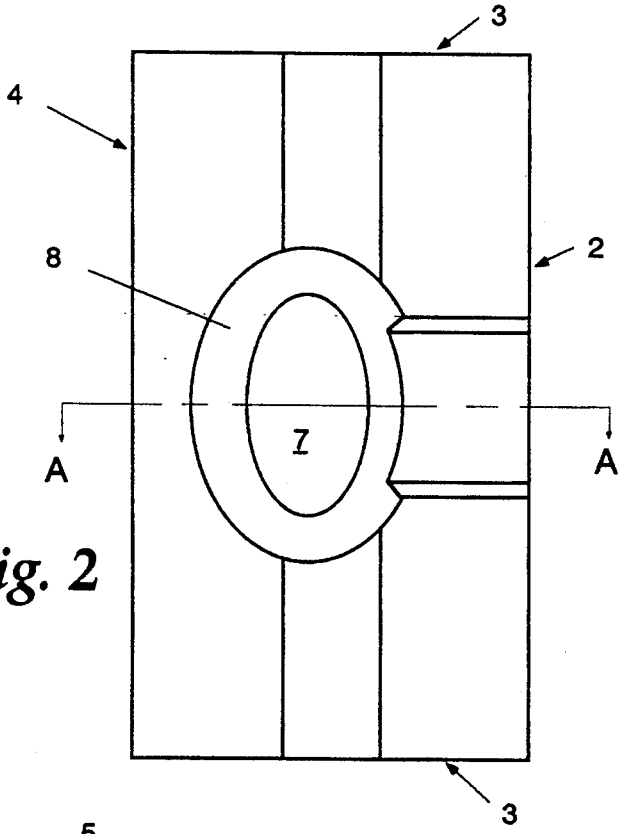
FIG. 2 shows a top plan view of the contoured pillow of FIG. 1.
Figure 3:
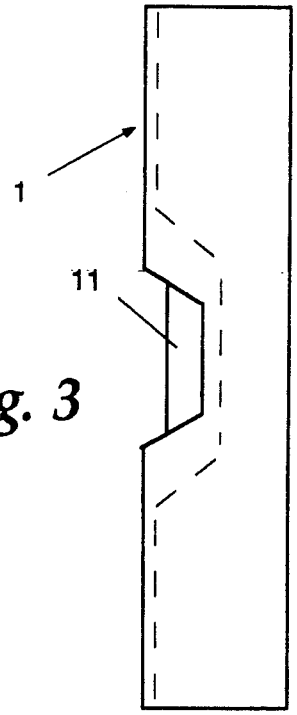
FIG. 3 shows a side elevational view of the contoured pillow of FIG. 1.
Figure 4:
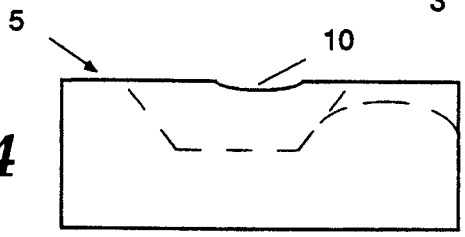
FIG. 4 shows another side elevational view of the contoured pillow of FIG. 1.

Within the top panel is an elliptically shaped depression 6 that is positioned in the center of the pillow lengthwise but is offset from center widthwise, as best seen in FIG. 2. The depression includes a bottom wall 7 and a continuous sloping side wall 8 surrounding the periphery of the depression. The top panel further includes elevated sections 9 on either side of the depression 6. Within these elevated side sections are shallow grooves 10 that extend lengthwise across the pillow from the depression 6 to the side panels 3.

The front panel 2 is of a uniform height except within the center where a semicircular ridge 11 is formed. The ridge is contoured along a semi-circular path from the front panel 2 to the elliptical depression 6. Sloping side walls 12 connected the ridge 11 with the top panel 5.

The use of the pillow is best seen in FIGS. 5–8. FIG. 5 shows a person 13 lying in the supine position (or on the back). The anatomical distance from the posterior of the head 14 to the top of the back 15 when lying on one's back is of a relatively small dimension. Most conventional pillows do not address this fact. Soft pillows naturally conform so that a person's head sinks into the pillow until it reaches a level position. Hard or foam pillows, though, generally position the posterior of the head much higher than soft pillows which causes the head to be at an angle. Furthermore, neither soft nor hard conventional pillows have anything that supports a person's neck 16. FIG. 5 shows how the contoured pillow of the present invention is ideal for supporting a person's head and neck while in a supine position.

The posterior of the head 14 sinks somewhat into the bottom 7 of the elliptical depression to position the head in an overall level position. The ridge 11 supports the person's neck 16 so that stress within the neck is prevented while sleeping in this position. The semi-circular nature of the curved ridge closely corresponds to the curved nature of the back of a person's neck.

The depression and ridge function well in supporting a person's head and neck while sleeping on his/her back. However, the widths of the depression and ridge also give the person flexibility in moving their head while on one's back. FIG. 6 shows a person's head 17 in an upright or vertical position in dark lines. The light lines represent the freedom of movement the head is allowed while sleeping on one's back. In normal sleep it is connection for a person to move their head back and forth. To strictly confine the head to an upright position, as some contoured pillows do, is uncomformable for most individuals. The sloping walls 8 and 12 in addition to the wide nature of the depression 6 and ridge 11 allow the head 17 to roll at a 45° angle in either direction while keeping stress from developing in a person's neck.

FIG. 7 also shows that the head 17 may be positioned in the center of the depression, as shown in dark lines, or moved from side to side within the depression. The side-to-side freedom of movement is also desirable in sleep because a person is rarely aware of the exact position of their head on the pillow. Furthermore, the width of the depression allows the person to naturally bend his/her neck at an angle within the depression without being constricted by the side 8 of the depression. It is difficult for a person to maintain their head at a straight angle relative to the pillow, while sleeping. This latter mentioned feature allows for such bending of the neck.

FIG. 8 shows the pillow in use as the body rolls from a supine position to a side position. The sloping walls 8 and 12 allow the head 17 within the center of the pillow (shown in dark lines) to easily roll onto the elevated side sections 9 (head shown in faint lines). In the side sleeping position, the head is positioned at a correct height when resting on these elevated sections. This is because the anatomical distance from the side of a person's head to the edge of the person's shoulder is much greater than the previous anatomical distance set forth between the posterior of the head to the top of the back. Thus, the contoured pillow of the present invention accounts for the difference in these distances and prevents stress from building in either the head, neck, shoulders, or back.

FIG. 8 additionally shows the longitudinal grooves 10, in dashed lines, for protecting the ear from being pressed down into the foam material of the pillow.

It should be appreciated from the description, above, that the contoured pillow of the present invention resolves all of the deficiencies of conventional pillows and the contoured pillows described within the background of the invention. The pillow can be used in a variety of sleeping positions and prevents stress from occurring within a person's body in all of these positions. The one piece nature of the pillow allows the pillow to be easily used without prior configuration of the pillow before sleep. Additionally, the pillow's corners can be rounded so that the pillow is virtually indistinguishable from a conventional pillow when a pillow case surrounds the pillow. This is especially handy if the pillow is to be used on a day-to-day basis. The dimensions of the pillow allow for a much longer wear characteristics of the pillow when compared to other contoured pillows that require the head to be positioned on the same point of the pillow, at all times.

It should be apparent that many modifications could be made to the contoured pillow which would still be encompassed within the spirit of the present invention. It is intended that all such modifications may fall within the scope of the appended claims.

What is claimed is:

1. A pillow for resting one's head and neck in a plurality of resting positions, comprising:

a body, said body comprising six relatively planar sides along three orthogonal directions, said body having a length, width and depth corresponding to said three orthogonal directions;

a first planar side comprising a top panel of said body, said top panel having a central depression and a pair of elevated portions on either side of said depression;

a second planar side comprising a front panel of said body, said front panel having a ridge along an intermediate portion of the length of said front panel, said ridge having a depth less than the depth of said body;

wherein, said depression supports one's head and said ridge supports one's neck when lying on one's back and one of said elevated portions supports one's head when lying on one's side;

side central depression having an elliptically shaped base and a continuous upwardly sloping side wall, said base having a depth less than the depth of said ridge support;

the long dimension of said elliptical base lies in a line with the length of said body and the short dimension of said elliptical base lies in a line with the width of said body.

2. A pillow as claimed in claim 1, wherein, said length is of a greater dimension than said width.

3. A pillow as claimed in claim 1, wherein, each of said elevated portions comprises a longitudinal groove, said groove extending from the edge of said body to said central depression, said groove having a depth smaller than the depth of said central depression wherein said groove is able to enclose one's ear when sleeping on one's side.

4. A pillow as claimed in claim 1, wherein, said ridge is semi-circular in elevation which extends from said front panel to said central depression.

* * * * *